US007648137B2

(12) United States Patent
Ogashiwa

(10) Patent No.: US 7,648,137 B2
(45) Date of Patent: Jan. 19, 2010

(54) MEDIUM EJECTION DEVICE AND IMAGE FORMING APPARATUS

(75) Inventor: Sakae Ogashiwa, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 12/178,105

(22) Filed: Jul. 23, 2008

(65) Prior Publication Data

US 2009/0026699 A1 Jan. 29, 2009

(30) Foreign Application Priority Data

Jul. 27, 2007 (JP) ..... 2007-196392

(51) Int. Cl.
*B65H 31/00* (2006.01)

(52) U.S. Cl. ..... 271/207; 399/405; 271/278

(58) Field of Classification Search ..... 271/207, 271/278

See application file for complete search history.

(56) References Cited

U.S. PATENT DOCUMENTS 6,047,959 A * 4/2000 Baba et al. ..... 271/3.01
2006/0181000 A1* 8/2006 Nishida et al. ..... 271/176
2007/0048055 A1* 3/2007 Ishikuro ..... 399/405
2008/0122164 A1* 5/2008 Sparer et al. ..... 271/207

FOREIGN PATENT DOCUMENTS

JP 2000-219378 A 8/2000

* cited by examiner

*Primary Examiner*—Kaitlin S Joerger
(74) *Attorney, Agent, or Firm*—Panitch Schwarze Belisario & Nadel LLP

(57) ABSTRACT

A medium ejection device includes an ejection member, a stacking member and a rib. The ejection member ejects a medium toward a medium ejection direction. The stacking member stacks the medium ejected from the ejection member. The rib is disposed in a substantially up and down direction, and is contacted by a tailing end of the medium ejected from the ejection member. The rib includes a convex portion protruding toward the stacking member in an upper portion thereof.

14 Claims, 8 Drawing Sheets

MEDIUM EJECTION DEVICE AND IMAGE FORMING APPARATUS

BACKGROUND OF THE INVENTION

1. Field of the Invention

The present invention relates to a medium ejection device and an image forming apparatus.

2. Description of Related Art

A prior art image forming apparatus includes a prior art ejection mechanism to eject a medium such as a sheet therefrom.

Japanese Un-examined Patent Application Publication No. 2000-219378 discloses a sheet conveyance device as an example of the prior art ejection mechanism. The sheet conveyance device includes a drive roller and a driven roller to eject the medium from the prior art image forming apparatus. A surface of the driven roller includes a plurality of protrusions. Specifically, a surface of an outer circumference of the driven roller includes the plurality of protrusions extended in an axial direction of a rotation axis thereof. In this regard, when the driven roller is rotated, a tailing end of the medium is pushed toward a medium ejection direction by an inclined plane having the protrusions so that the medium is smoothly conveyed.

Referring to FIGS. 13 and 14, the conventional ejection mechanism such as the sheet conveyance device is illustrated. A driven roller 101 pushes a tailing end of a medium PP, and a medium stacker 103 stacks the medium PP thereon as a stacking member. A wall member 105 is disposed in a standing manner from the medium stacker 103 toward the driven roller 101. In such a sheet conveyance device, the tailing end of the medium PP pushed by the driven roller 101 contacts the wall member 105, causing an increase in a frequency of inappropriate stack of the medium PP on the medium stacker 103.

BRIEF SUMMARY OF THE INVENTION

At least one aspect of the present invention provides a medium ejection device including an ejection member ejecting a medium toward a medium ejection direction, a stacking member stacking the medium ejected from the ejection member, and a rib disposed in a substantially up and down direction being contacted by a tailing end of the medium ejected from the ejection member and including a convex portion protruding toward the stacking member in an upper portion thereof.

At least one aspect of the present invention provides an image forming apparatus including the medium ejection device.

Additional features and advantages of the present invention will be more fully apparent from the following detailed description of embodiments, the accompanying drawings and the associated claims.

BRIEF DESCRIPTION OF THE DRAWINGS

A more complete appreciation of the aspects of the invention and many of the attendant advantage thereof will be readily obtained as the same becomes better understood by reference to the following detailed description when considered in connection with the accompanying drawings, wherein.

DETAILED DESCRIPTION OF PREFERRED EMBODIMENTS

Figure 1:
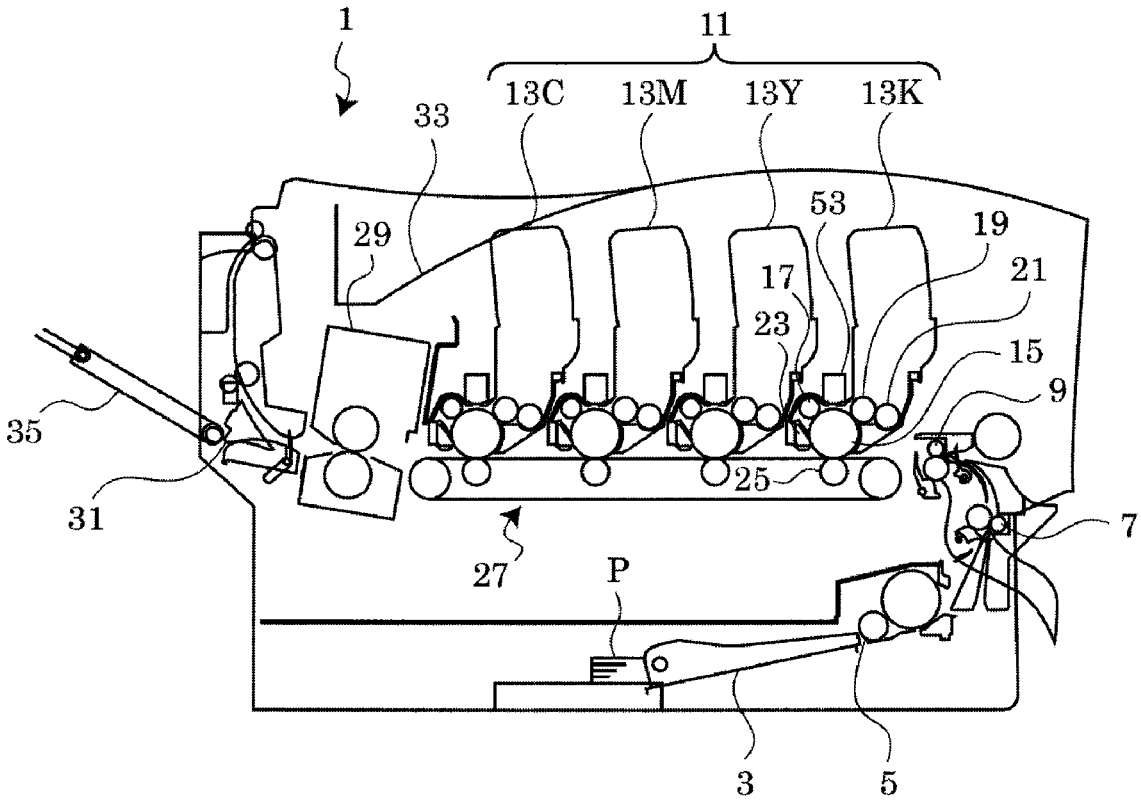
FIG. 1 is a cross-sectional view illustrating a printer as an image forming apparatus according to an embodiment of the present invention.

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Reference is now made to the drawings, wherein like reference numerals designate identical or corresponding parts throughout the several views.

Referring to FIG. 1, a printer 1 as an image forming apparatus according to an embodiment of the present invention is illustrated. Since the embodiment of the present invention applies to the image forming apparatus, the printer 1 employing an electrophotographic method and capable of producing color images is described in detail as representative of the image forming apparatus.

As illustrated in FIG. 1, the printer 1 includes a feeding stacker 3 on which a medium P is stacked. A feeding roller 5 feeds the medium P stacked on the feeding stacker 3 in a downstream direction relative to a medium conveyance path. Each pair of conveyance rollers 7 and 9 conveys the medium P fed by the feeding roller 5 to a direction toward a development unit 11 that includes development devices 13C, 13M, 13Y and 13K. Each of the development devices 13C, 13M, 13Y and 13K forms an image with a respective color of a developer, cyan, magenta, yellow and black which are abbreviated as C, M, Y and K, respectively. As each of the development devices 13C, 13M, 13Y and 13K is substantially similar to one another, a development device 13 is hereafter described as representative of the development devices 13C, 13M, 13Y and 13K.

The development device 13 includes a photosensitive drum 15 as a latent image carrier, a charging roller 17 charging the photosensitive drum 15, a development roller 19 developing the latent image, a cleaning blade 23 cleaning a surface of the photosensitive drum 15, and a supply roller 21 supplying the developer to the development roller 19. The photosensitive drum 15 is irradiated by an exposure device 53, thereby forming the latent image on the surface thereof. The exposure device 53 is, for example, a Light Emitting Diode (LED), and is positioned opposite to the photosensitive drum 15 and an outside the development device 13. A transfer roller 25 is disposed corresponding to the development device 13, and transfers the image developed by the development device 13 onto the medium P conveyed on a conveyance belt unit 27. Each image developed by respective development device 13 is successively transferred onto the medium P so that the printer 1 forms the image on the medium P based on printing data. Subsequently, the medium P is conveyed to a fixing device 29 that is disposed in a downstream direction of the development unit 11 relative to the medium conveyance path. The fixing device 29 fixes the developed image formed on the medium P with heat and pressure. Upon fixing the image, the medium P is further conveyed in the downstream direction relative to the medium conveyance path.

The printer 1 includes a medium guide 31 that is disposed in the downstream direction of the fixing device 29 relative to the medium conveyance path. The medium guide 31 guides the medium P toward a direction of at least one of a face-down stacker 33 and a face-up stacker 35 that are disposed in an upper portion and a side of the printer 1 respectively.

Figure 2:
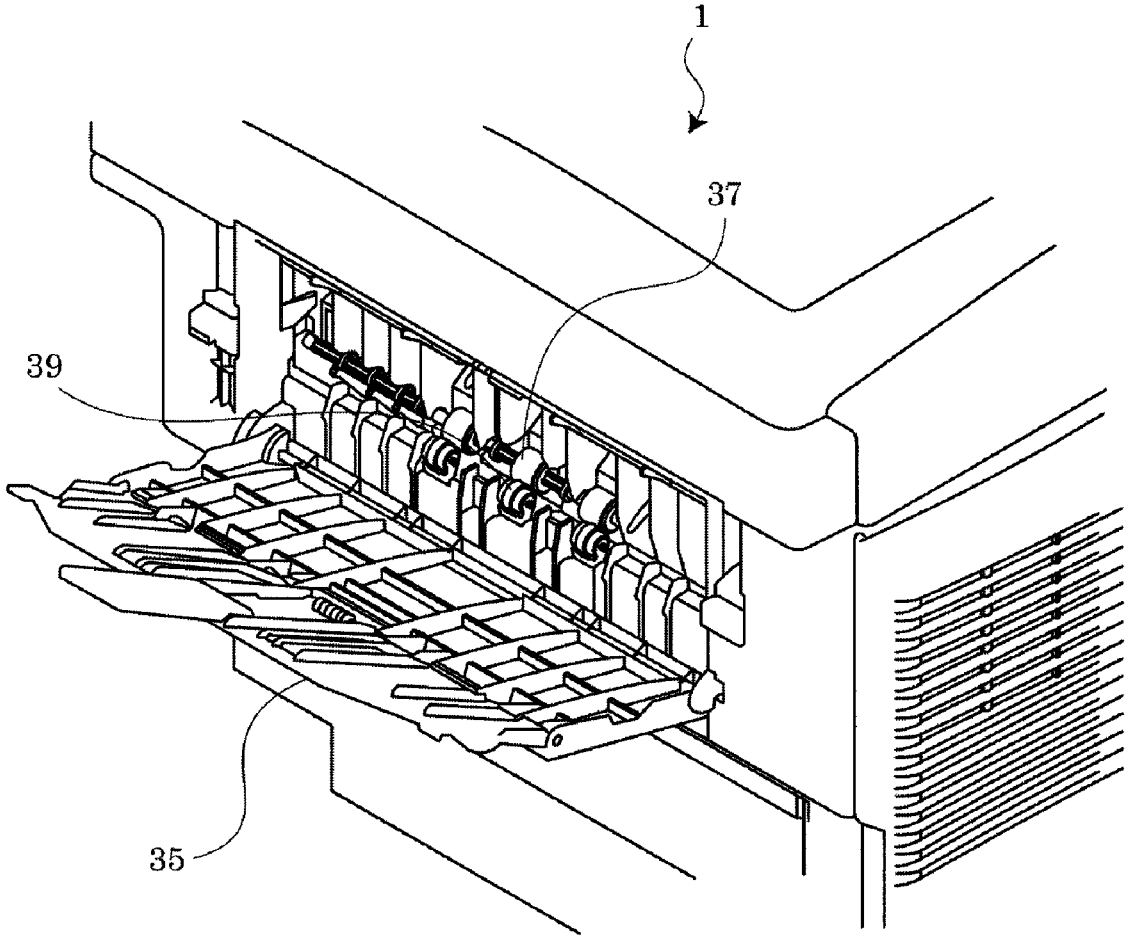
FIG. 2 is a perspective view illustrating a side of the printer of FIG. 1.

Referring to FIG. 2, a side of the printer 1 is illustrated. The face-up stacker 35 is mounted to a side frame of the printer 1. A rear end of the face-up stacker 35 relative to a medium ejection direction is rotatably supported by the printer 1. When the medium P is ejected, for example, the face-up stacker 35 is supported with an angle of an approximately 15 degrees to a horizontal direction. Therefore, the face-up stacker 35 reduces (if not prevent) a possibility of dropping the medium P therefrom in the medium ejection direction. According to the embodiment, the medium ejection direction represents a vertical direction relative to a side surface of the printer 1, that is, a horizontal direction.

The printer 1 further includes an ejection member such as an ejection roller 37 and an ejection driven roller 39. The ejection roller 37 ejects the medium P guided by the medium guide 31 along the medium ejection direction, and an ejection driven roller 39 as a driven roller rotates in response to driving of the ejection roller 37. The ejection roller 37 and the ejection driven roller 39 sandwich the medium P and convey in the direction toward the face-up stacker 35 so that the medium P is ejected on the face-up stacker 35.

Figure 3:
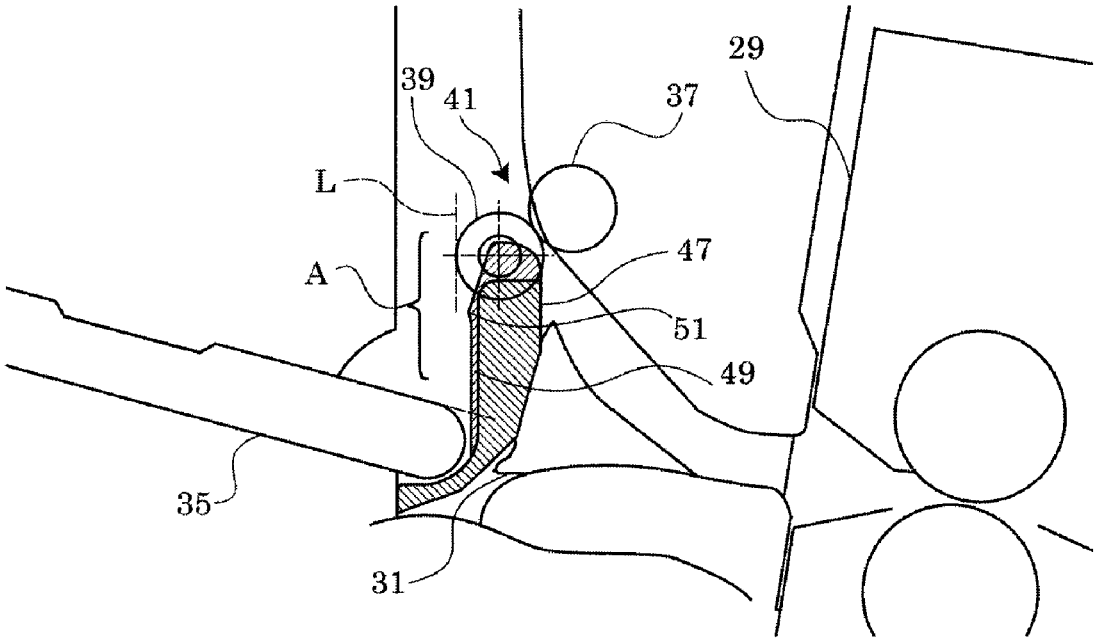
FIG. 3 is a cross-sectional view partially illustrating the side of the printer of FIG. 1.

Referring to FIG. 3, the side of the printer 1 is illustrated in a cross-sectional view. The ejection roller 37 and the ejection driven roller 39 are disposed in a vicinity of an ejection opening 41 from which the medium P is ejected to the face-up stacker 35. As illustrated in FIG. 3, the ejection roller 37 is disposed substantially above the ejection driven roller 39 in the vicinity of the ejection opening 41 so that the ejection roller 37 and the ejection driven roller 39 sandwich and convey the medium P. The descriptions of a tangent line L and an area A in FIG. 3 will be given later.

Figure 4:
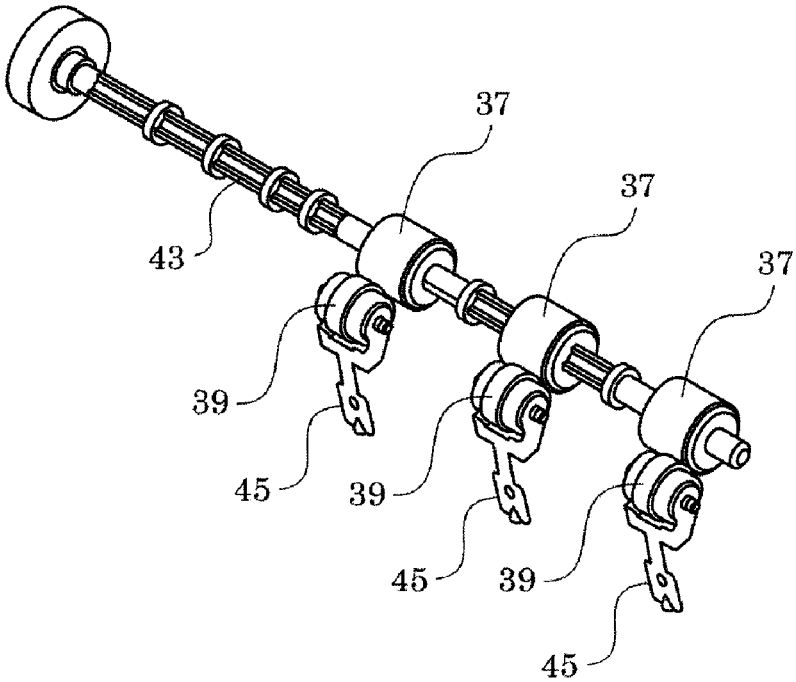
FIG. 4 is a perspective view illustrating an ejection roller and an ejection driven roller disposed in the printer of FIG. 1.
Figure 5:
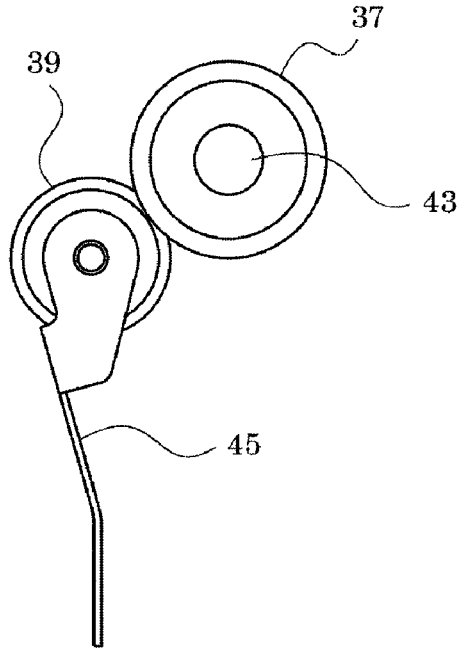
FIG. 5 is an elevation view illustrating the ejection roller and the ejection driven roller of FIG. 4.

Referring to FIGS. 4 and 5, the ejection roller 37 and the ejection driven roller 39 are illustrated in a perspective view and an elevation view respectively. The ejection roller 37 is integrally secured to a shaft 43 that is rotated by a driving force applied by a driving source (not shown). The ejection roller 37 rotates in response to a rotational movement of the shaft 43. As illustrated in FIG. 4, a plurality of the ejection rollers 37 and the ejection driven rollers 39 are disposed. Each ejection driven roller 39 is disposed corresponding to respective ejection roller 37, and is mounted to respective leaf spring 45. One end of each leaf spring 45 is secured to the printer 1, thereby applying force to the ejection roller 37.

As illustrated in FIG. 3, the ejection opening 41 is disposed with a suitable distance from the rear end of the face-up stacker 35 in a vertical direction, and is positioned higher than the rear end of the face-up stacker 35.

A wall 47 is disposed in such a manner to stand from directly below the vicinity of the ejection driven roller 39 toward the ejection driven roller 39.

Figure 7:
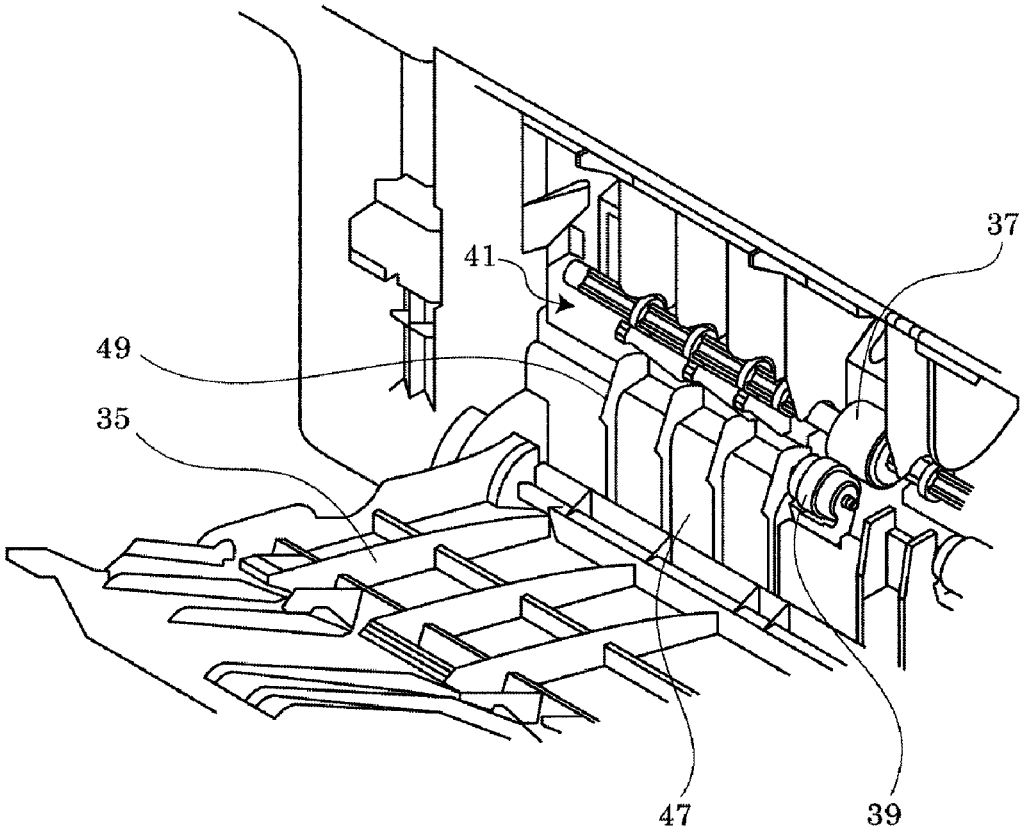
FIG. 7 is another perspective view illustrating the side of the printer of FIG. 1.

Referring to FIG. 7, the side of the printer 1 is illustrated in another perspective view. The printer 1 includes a plurality of ribs 49 that reduce (if not prevent) an occurrence of contacting the wall 47 with the tailing end of the medium P ejected from the ejection opening 41. The plurality of ribs 49 guide the medium P in the direction of the face-up stacker 35 being inclined, and are formed of a plurality of plate members. Each of the plate members is arranged in a longitudinal direction of the wall 47, and has substantially the same shape with a thickness of approximately 1.2 mm. Since each of the plurality of ribs 49 is substantially similar to one another, one of the ribs 49 is hereafter described as representative of the plurality of the ribs 49. The rib 49 is disposed in a substantially vertical direction along a surface of the wall 47 on a side near the face-up stacker 35, and an upper portion thereof is positioned in a vicinity of the ejection opening 41. The rib 49 is preferably disposed, for example, between the plurality of ejection driven rollers 39 with an even interval. According to the embodiment, the rib 49 is disposed in a standing manner in a substantially vertical direction.

Each of the plurality of ribs 49 includes a guide 51 as a convex portion to guide the medium P such that the tailing end of the medium P is separated from the wall 47 and guided to the medium ejection direction. The guide 51 thus formed protrudes from the rib 49 toward the face-up stacker 35. An upper portion of the guide 51 is inclined from the ejection opening 41 toward the medium ejection direction in such a manner that a height of the rib 49 gradually decreases. A tip of the guide 51 preferably protrudes toward the medium ejection direction relative to a position in which the tailing end of the medium P contacts the rib 49 in the course of stacking of the medium P. The guide 51 is described in detail below with reference to FIG. 6.

Figure 6:
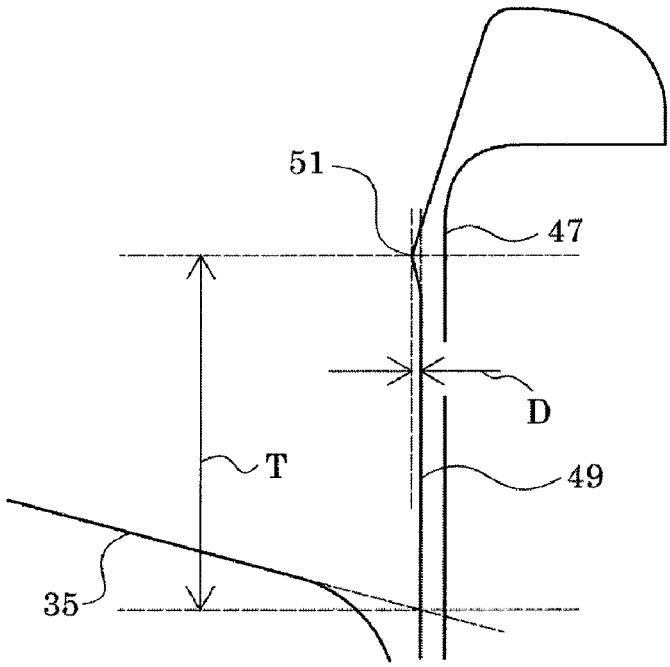
FIG. 6 is an enlarged schematic diagram partially illustrating the printer of FIG. 3.

FIG. 6 illustrates the area A of FIG. 3 in an enlarged schematic view. The tip of the guide 51 has a protrusion distance D of approximately 1.2 mm according to the embodiment of the present invention. The protrusion distance D represents a distance from a side of the rib 49 in the medium ejection direction to the tip of the guide 51. In addition to the protrusion distance D, a distance T is provided. The distance T represents a distance in a vertical direction from the tip of the guide 51 to a position in which the tailing end of the medium P stacked at a bottommost layer contacts the rib 49. According to the embodiment, the distance T is approximately 20 mm. Such disposition of the guide 51 allows the tailing end of the medium P to move down when the medium P is ejected. In other words, the tailing end of the medium P falls with acceleration toward the medium ejection direction relative to the side of the rib 49 near the face-up stacker 35, thereby reducing (if not preventing) a possibility of contacting the rib 49 below the guide 51 in the course of falling. When the media P as a whole is pushed back to a direction opposite to the medium ejection direction due to contacting the face-up stacker 35 with a leading end thereof during a period of time in which the tailing end thereof falls, the protrusion distance D is extended so that the tailing end of the medium P can reduce (if not prevent) a possibility of contacting the rib 49 below the guide 51 in the course of falling.

The tip of the guide 51 is preferably disposed at an upstream side of the tangent line L relative to the medium ejection direction. The tangent line L is provided at a downmost stream of the ejection driven roller 39 relative to the medium ejection direction as illustrated in FIG. 3. When the tip of the guide 51 protrudes from the tangent line L, the tailing end of the medium P falls from the ejection driven roller 39 while contacting the guide 51 with an increase in a contact area between the guide 51 and the medium P. The increase in the contact area causes an increase in friction between the guide 51 and the medium P, and the medium P consequently may be stuck on the guide 51. Therefore, the guide 51 is disposed at the upstream side of the tangent line L relative to the medium ejection direction so that the tailing end of the medium P can reduce (if not prevent) a possibility of being stuck on the guide 51.

Figure 8:
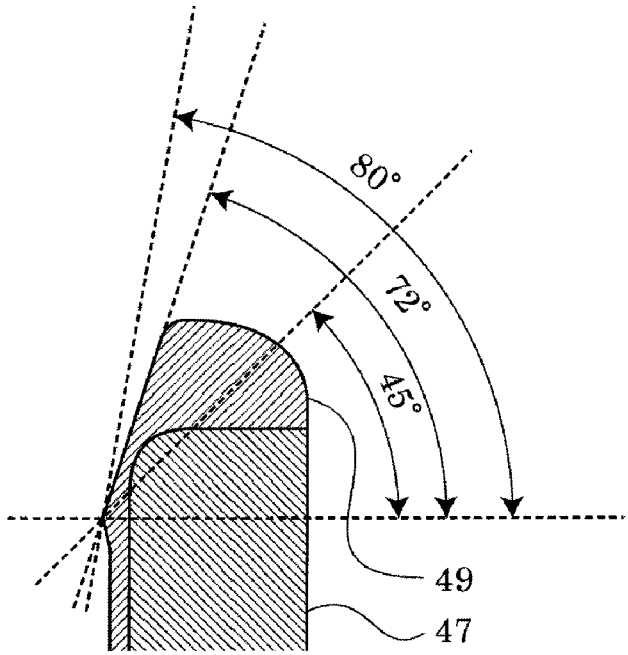
FIG. 8 is schematic diagram illustrating a gradient angle of a guide member of a rib disposed in the printer of FIG. 1.

Referring to FIG. 8, a gradient angle of an upper surface of the guide 51 is illustrated. The gradient angle is preferably between approximately 45 and 80 degrees with respect to a horizontal direction. When the gradient angle of the guide 51 becomes closer to a horizontal position, the medium P needs a longer time period to fall. Consequently, the medium P increases a movement amount in the horizontal direction, causing inappropriate stack of the medium P on the medium stacker 35. In addition, when the gradient angle of the guide 51 becomes closer to the horizontal position, a vertical drag force applied from the guide 51 to the medium P increases. Such an increase in the vertical drag force causes an increase in a friction between an upper surface of the guide 51 and the medium P, thereby causing the medium P to be stuck to the guide 51. Therefore, the gradient angle of the guide 51 needs to be equal to or larger than 45 degrees to reduce an occurrence of sticking the medium P to the guide 51 and the inappropriate stack of the medium P. On the other hand, when the gradient angle of the guide 51 is larger than 80 degrees, the medium P becomes difficult to move toward the medium ejection direction. For example, when the tailing end of the medium P is rolled in the ejection driven roller 39 in a state that the gradient angle is larger than 80 degrees, the medium P is difficult to move toward the medium ejection direction. According to an experiment by the inventor, the medium P was most appropriately ejected at the gradient angle of approximately 72 degrees. Therefore, the gradient angle of the guide 51 is preferably 72 degrees within the preferable range of approximately 45 to 80 degrees. The gradient angle of the guide 51 may be changed as needed, for example, depending on a weight and a kind of the medium P for use in the printer 1.

Figure 9:
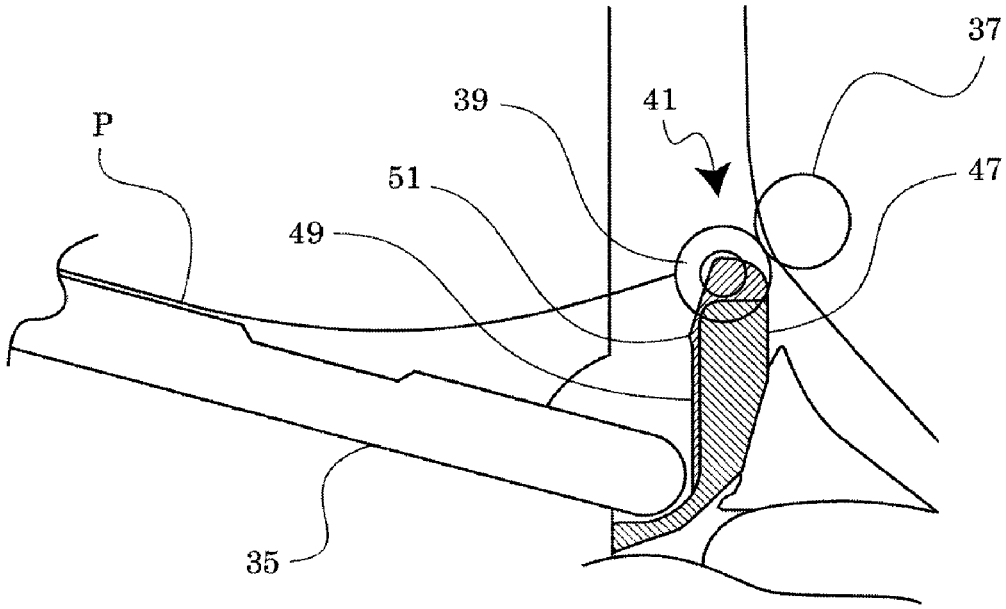
FIG. 9 is an enlarged cross-sectional view illustrating a movement of a medium ejected from the printer of FIG. 1.
Figure 10:
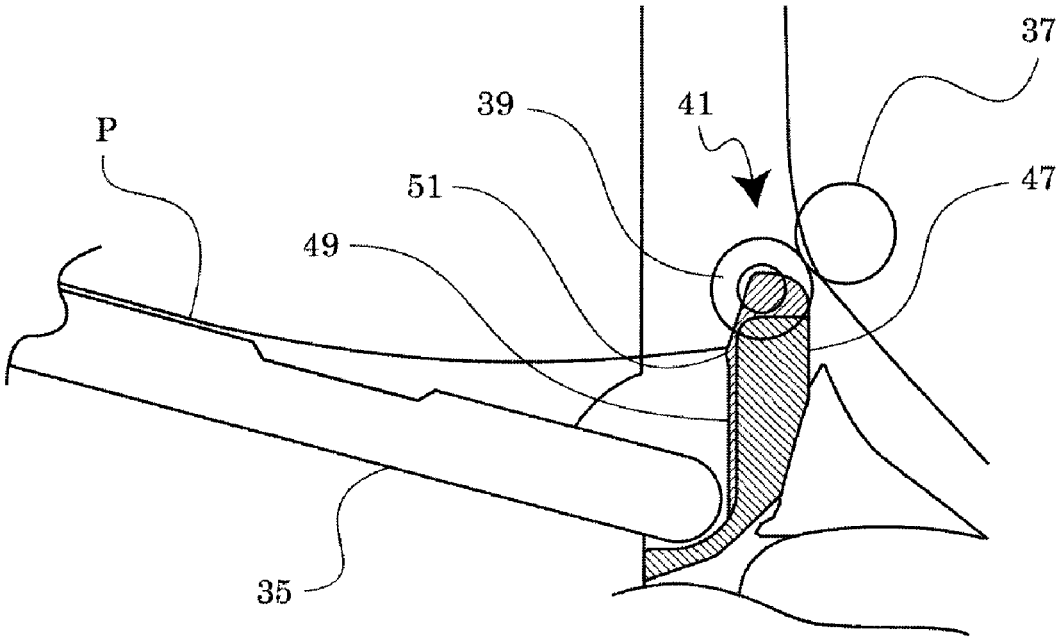
FIG. 10 is another enlarged cross-sectional view illustrating a movement of the medium ejected from the printer of FIG. 1.
Figure 11:
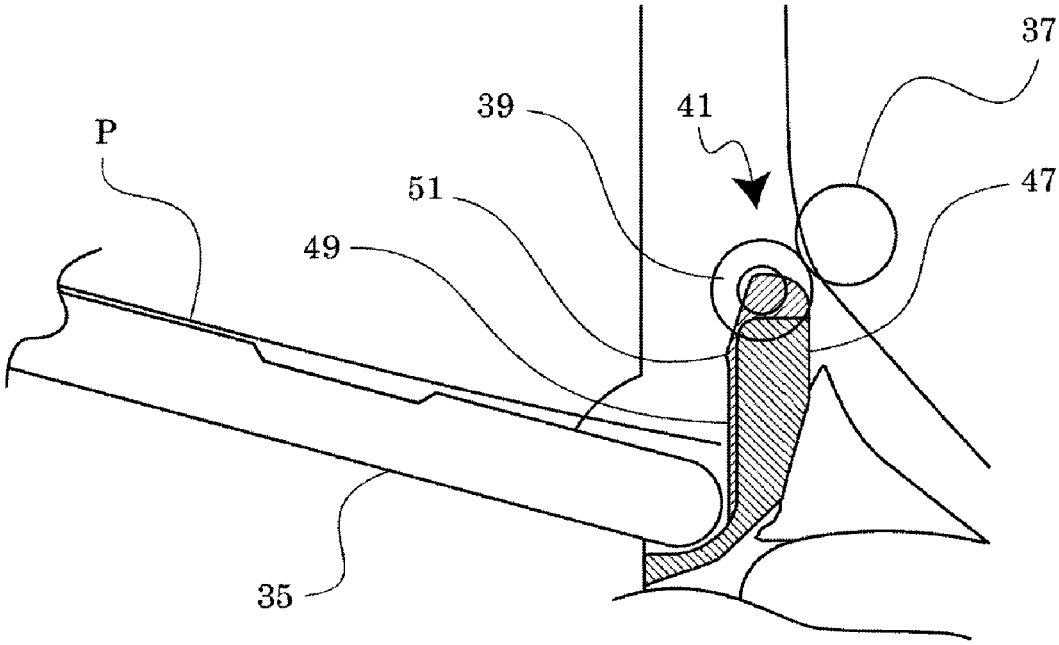
FIG. 11 is yet another enlarged cross-sectional view illustrating another movement of the medium ejected from the printer of FIG. 1.

Referring to FIGS. 9 through 11, the medium P is ejected from the ejection opening 41 of the printer 1, and a movement thereof is illustrated. As illustrated in FIG. 9, when the medium P is ejected from the ejection opening 41, the leading end thereof contacts the face-up stacker 35. Subsequently, the tailing end of the medium P is separated from the ejection driven roller 39 in a vicinity of a position in which the tangent line L is provided, and then falls. The medium P is pushed back toward the rib 49, for example, by a force applied toward the medium ejection direction from the face-up stacker 35 to the medium P, or by a situation in which the medium P is rolled in the ejection roller 39. As illustrated in FIG. 10, when the medium P is pushed back to toward the rib 49, the tailing end of the medium P contacts the guide 51 and moves along the inclined upper surface of the guide 51 toward a direction away from the rib 49. The tailing end of the medium P is separated from the rib 49 and falls as illustrated in FIG. 11, thereby reducing (if not preventing) a possibility of contacting the rib 49 with the tailing end thereof.

According to a prior art image forming apparatus, a medium is stacked on a medium stacker in an inappropriate manner. Specifically, a plurality of media are inappropriately stacked while being successively ejected. In this regard, a medium stacked at a bottom layer on the medium stacker is folded and bended by a weight of the stacked media in the prior art image forming apparatus. However, the printer 1 as the image forming apparatus according to the embodiment of the present invention can appropriately stack the medium P on the face-up stacker 35, thereby reducing (if not preventing) a possibility of folding and bending the medium P.

According to the embodiment of the present invention, each of the plurality of ribs 49 has substantially the same shape. However, the plurality of ribs 49 may be modified as a modification of the embodiment, and the description thereof is given below with reference to FIG. 12.

Figure 12:
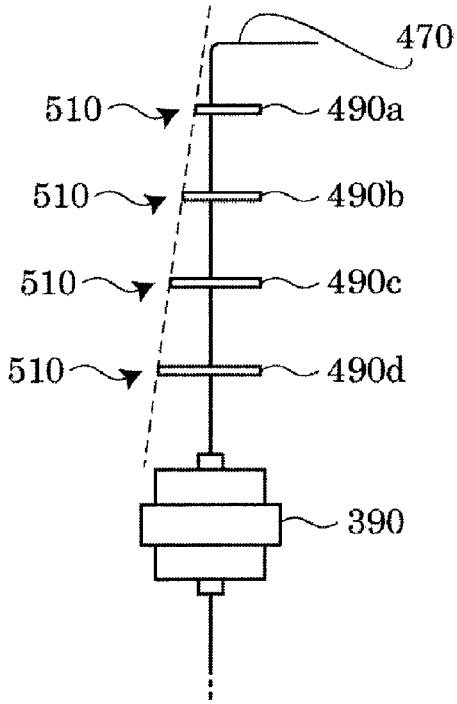
FIG. 12 is a schematic top view illustrating the rib according to a modification of the printer of FIG. 1.
Figure 13:
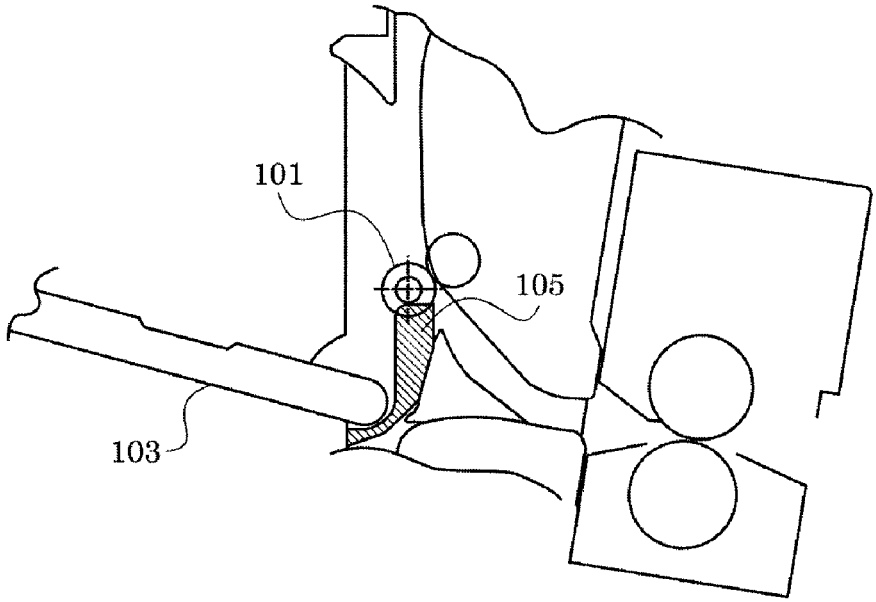
FIG. 13 Prior Art
FIG. 13 is a cross-sectional view illustrating a prior art sheet conveyance device disposed in a conventional image forming apparatus.
Figure 14:
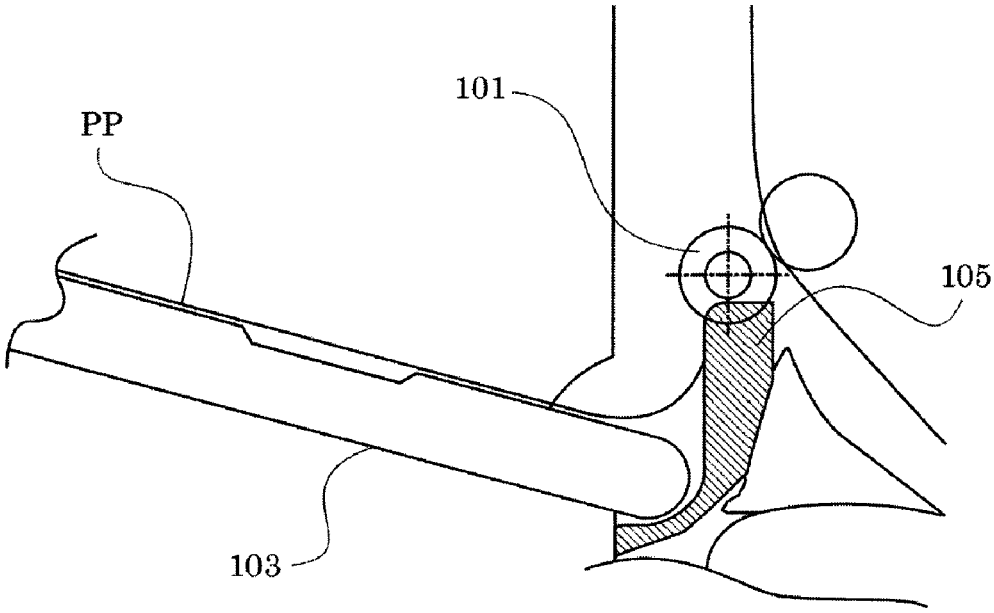
FIG. 14 Prior Art
FIG. 14 is an enlarged cross-sectional view partially illustrating the prior art sheet conveyance device of FIG. 13.

The modification of the embodiment includes guides 510 and ribs 490*a*, 490*b*, 490*c* and 490*d*. The guides 510, ribs 490*a*, 490*b*, 490*c* and 490*d*, and an ejection driven roller 390 in FIG. 12 respectively perform similar to the guides 51, ribs 49, and the ejection driven roller 39 of the embodiment described above, and descriptions of elements which have already been described with respect to FIG. 1 and other figures are omitted. As illustrated in FIG. 12, each of the ribs 490*a*, 490*b*, 490*c* and 490*d* includes the guide 510, and protrusion distances are formed between the ribs 490*a*, 490*b*, 490*c* and 490*d* and respective guide 510. Each of the protrusion distances may be different, and may be increased with a decrease in a distance to a middle portion in a direction perpendicular to the medium ejection direction. The guide 510 of the rib 490*d* are disposed in the shortest distance position from the middle portion, and the protrusion distance thereof is approximately 1.5 mm, for example. The guide 510 of the ribs 490*a* is disposed in the furthest position from the middle portion in the direction perpendicular to the medium ejection direction, and the protrusion distance thereof is preferably approximately 0.5 mm, for example. Such modification allows the guide 510 to move the medium P in the course of falling such that a middle portion of the medium P is separated from the wall 47, thereby reducing a contact of the guides 510 and the medium P at each end of the medium P. Consequently, the modification of the embodiment allows the medium P to fall more appropriately.

As can be appreciated by those skilled in the art, numerous additional modifications and variation of the present invention are possible in light of the above-described teachings. It is therefore to be understood that, within the scope of the appended claims, the disclosure of this patent specification may be practiced otherwise than as specifically described herein.

What is claimed is:

1. A medium ejection device comprising:

an ejection member configured to eject a medium toward a medium ejection direction;

a stacking member configured to stack the medium ejected from the ejection member; and a rib disposed in a substantially up and down direction configured to be contacted by a tailing end of the medium ejected from the ejection member, the rib including at an upper portion thereof a convex portion protruding toward the stacking member and a lower portion defining a peripheral surface, wherein the convex portion protrudes away from the rib such that a plane which is parallel to the peripheral surface and passes through an outermost end of the convex portion, is spaced from the peripheral surface.

2. The medium ejection device according to claim 1, wherein the ejection member comprises:

an ejection roller configured to convey the medium in the medium ejection direction; and a driven roller configured to sandwich and convey the medium with the ejection roller.

3. The medium ejection device according to claim 2, wherein the rib is disposed to a wall disposed in such a manner to stand toward the driven roller from directly below a vicinity of a pair of ejection rollers having the ejection roller and the driven roller.

4. The medium ejection device according to claim 3, wherein the rib is disposed to the wall in such a manner to protrude across the substantially up and down direction and toward a direction perpendicular to the medium ejection direction.

5. The medium ejection device according to claim 1, wherein the rib is disposed in such a manner to extend toward the ejection member from the stacking member.

6. The medium ejection device according to claim 1, wherein an upper surface of the convex portion is inclined to the medium ejection direction.

7. A medium ejection device comprising:

an ejection member configured to eject a medium toward a medium ejection direction;

a stacking member configured to stack the medium ejected from the ejection member; and a rib disposed in a substantially up and down direction configured to be contacted by a tailing end of the medium ejected from the ejection member, the rib including at an upper portion thereof a convex portion protruding toward the stacking member, wherein a distance protruded by the convex portion of the rib increases as toward a middle portion of the ejection member in a direction perpendicular to the medium ejection direction.

8. The medium ejection device according to claim 3, wherein the outermost end of the convex portion is positioned at an upstream side in the medium ejection direction relative to a tangent line provided at a downmost stream of the driven roller in the medium ejection direction.

9. The medium ejection device according to claim 1, wherein the convex portion includes a gradient area inclined with respect to a side of the ejection member.

10. The medium ejection device according to claim 9, wherein the gradient area is inclined substantially between 45 degrees to 80 degrees with respect to a horizontal direction.

11. The medium ejection device according to claim 10, wherein the gradient area is preferably inclined at substantially 72 degrees with respect to the horizontal direction.

12. A medium ejection device comprising:

an ejection member configured to eject a medium toward a medium ejection direction;

a stacking member configured to stack the medium ejected from the ejection member; and a rib disposed in a substantially up and down direction configured to be contacted by a tailing end of the medium ejected from the ejection member, the rib including at an upper portion thereof a convex portion protruding toward the stacking member, wherein the rib comprises a plurality of ribs, each convex portion of the plurality of ribs having an uneven distance protruded toward the medium ejection direction.

13. The medium ejection device according to claim 12, wherein the distance protruded by the convex portion of each of the plurality of ribs increases toward a middle portion in a direction perpendicular to the medium ejection direction.

14. An image forming apparatus comprising the ejection medium device according to claim 1.

* * * * *